United States Patent [19]

Focke

[11] 4,330,290

[45] May 18, 1982

[54] METHOD OF PRODUCING WRAPPING FOR CIGARETTES

[75] Inventor: Heinz Focke, Verden, Fed. Rep. of Germany

[73] Assignee: Focke & Pfuhl, Verden, Fed. Rep. of Germany

[21] Appl. No.: 130,685

[22] Filed: Mar. 17, 1980

Related U.S. Application Data

[60] Division of Ser. No. 922,697, Jul. 7, 1978, Pat. No. 4,213,362, which is a continuation of Ser. No. 827,634, Aug. 25, 1977, abandoned.

[30] Foreign Application Priority Data

Aug. 31, 1976 [DE] Fed. Rep. of Germany ..... 2639216

[51] Int. Cl.[3] ..... B31B 1/16

[52] U.S. Cl. ..... 493/372; 83/152; 493/239

[58] Field of Search ..... 83/152, 154, 100, 24, 83/23; 229/DIG. 9, 273; 493/239, 235, 343, 362, 361, 372, 340, 74

[56] References Cited

U.S. PATENT DOCUMENTS

| | | | |
|---|---|---|---|
| 1,310,923 | 7/1919 | Novick | 83/154 |
| 2,047,625 | 7/1936 | Geerlings | 229/DIG. 9 |
| 3,599,520 | 8/1971 | Wood | 83/43 X |
| 3,967,543 | 7/1976 | Seragnoli | 83/152 X |
| 4,012,275 | 3/1977 | S/ holm et al. | 83/100 X |

FOREIGN PATENT DOCUMENTS

| | | | |
|---|---|---|---|
| 611093 | 10/1960 | Italy | 83/152 |
| 2010781 | 7/1979 | United Kingdom | 229/DIG. 9 |

*Primary Examiner*—James F. Coan

*Attorney, Agent, or Firm*—Sughrue, Mion, Zinn, Macpeak and Seas

[57] ABSTRACT

A web 26 of packaging material on which a plurality of cigarette wrapper blanks 10 are defined in oppositely rotated and laterally displaced pairs, is fed between a reciprocatable punch 38 and a fixed support 36 having cooperating cutting edges 39 and counter edges 40, respectively, whereby the downward movement of the punch severs a pair of blanks from the web. The continued downward movement of the punch separates the two blanks of the severed pair through the cooperation of a further cutting edge 45 on the punch and a counter edge 46 on a turntable 41 disposed beneath the fixed support. The turntable is then rotated 180° to successively feed the separated blanks to a suction conveyor 47.

5 Claims, 7 Drawing Figures

Figure 1:
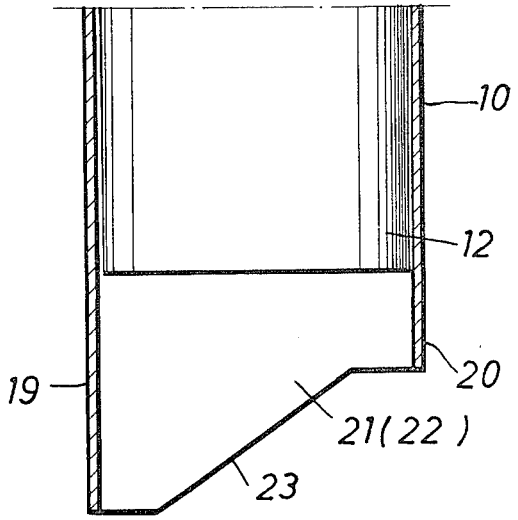

26
27
20
23
22
19
23
21
27
24
25
25
17
14
16
15
18

METHOD OF PRODUCING WRAPPING FOR CIGARETTES

This is a division of application Ser. No. 922,697, filed July 7, 1978, now U.S. Pat. No. 4,213,362 which is a Cont. Appln. of Ser. No. 827,634, filed Aug. 25, 1977, now abandoned.

The invention relates to a wrapping for cigarettes etc., especially a socalled soft wrapping, with a covering, which encloses the content of the package at least in the area of a bottom, of narrow lateral walls and a front wall and rear wall as well. Furthermore, the invention concerns the arrangement of blanks for production of such wrappings along a web etc., of wrapping material. Finally, the process and apparatus for the production, namely separation of the blanks from this web, are also object of the invention.

It is, in this case, a matter of a type of wrapping for cigarettes etc., which in principle has been known as soft wrapping. Such soft wrappings are built up such that the contents of the package namely a block of cigarettes wrapped in a tin foil blank, is received in an open sheating, a so-called soft cup. A cellophane blank has been provided as an outside wrapper of this package. The invention deals with the development and production of the sheating (soft cup) surrounding the tin foil wrapper.

Two different embodiments are known for the development of the wrapping designated as the soft cup. In the one, the blank is folded at first in the form of a hose, possibly with simultaneous wrapping of the content of the package. At the same time marginal flaps of the front and the rear wall are completely overlapped and interconnected in the area of the lateral walls. The bottom is formed by at first projecting flaps, and to be sure in such a way that a first lateral terminal flaps projecting in the area of the lateral walls and the bottom flaps pointing in longitudinal direction are folded. As a result, a so-called envelop fold develops.

The other embodiment of this wrapping is such that a blank, in case of which the front and rear walls are interconnected by way of the bottom, is folded U-shape from the bottom around the contents of the package. Lateral flaps overlap each other in the area of both lateral walls.

The invention is based on the task of developing and improving packages of the above mentioned type further, so that, while maintaining the constructional structure, there will be a lower requirement for packaging material.

In order to solve this problem, the wrapping of the invention is characterized in that overlapping flaps in the area of the bottom or of the lateral walls are developed with variable widths in such a way that blanks for the forming of the wrapping may be separated from a web or similar wrapping material without waste.

The basic idea of the invention thus consists in developing the blanks for making the packages or soft cup such, that the blanks may be separated without waste and at lower material requirements without essential changes of the geometry of folding in the area of the bottom and of the lateral walls. The flaps of variable width have, at the same time, been always disposed such, that the narrow flaps are folded first, therefore inward and the broad flaps outward. As a result the impression of a conventional fold is maintained in the outside optical impression, despite lower material expenditure.

Depending on the development of the blanks, the latter are disposed at two, side by side along the web, or individually in succession. In case of the arrangement of two blanks side by side, always two blanks are separated in one action from the web and are separated subsequently in an other separating process, one from the other. The separation of the blanks from the web and from one another takes place during the downward movement of the web from an arriving plane to a continuing one. For this purpose, the apparatus of the invention is equipped with a cutting plate which has two cutting edges, disposed displaced in relation to one another. These in turn cooperate with locally fixed cutting edges.

Further characteristics of the invention concern the constructive formation of the packing or of the blanks, the arrangement of the blanks in the area of a web of wrapping material, a process for separation of these and details of the apparatus.

Embodiments of the invention are explained in more detail subsequently on the basis of the drawings.

Figure 2:
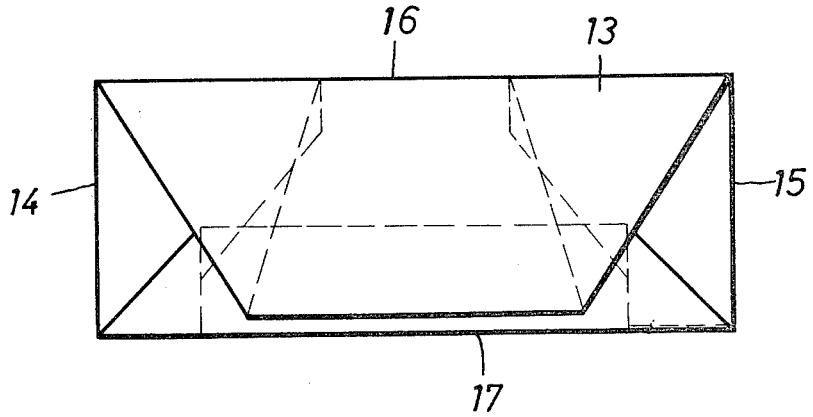
Figure 3:
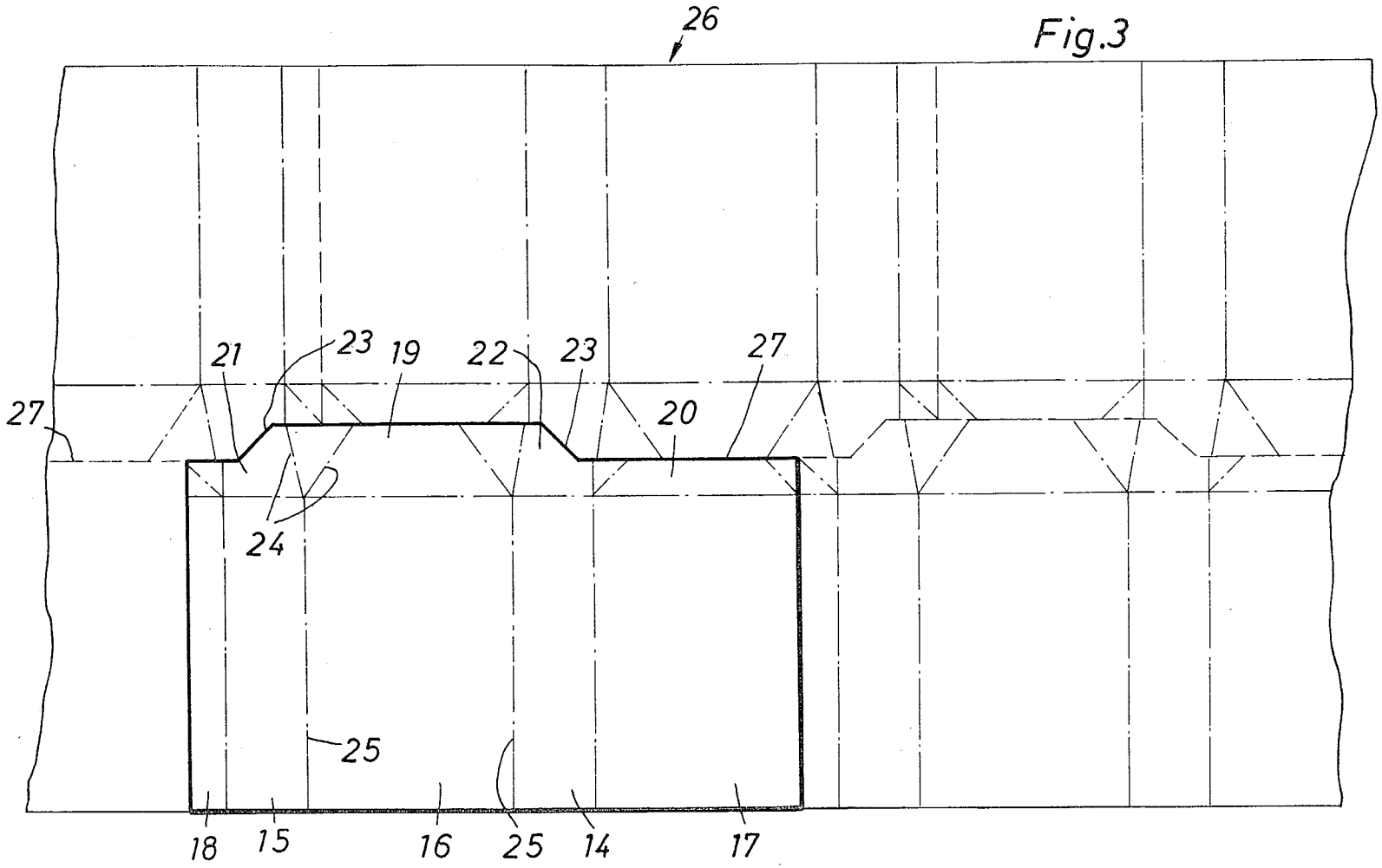
Figure 4:
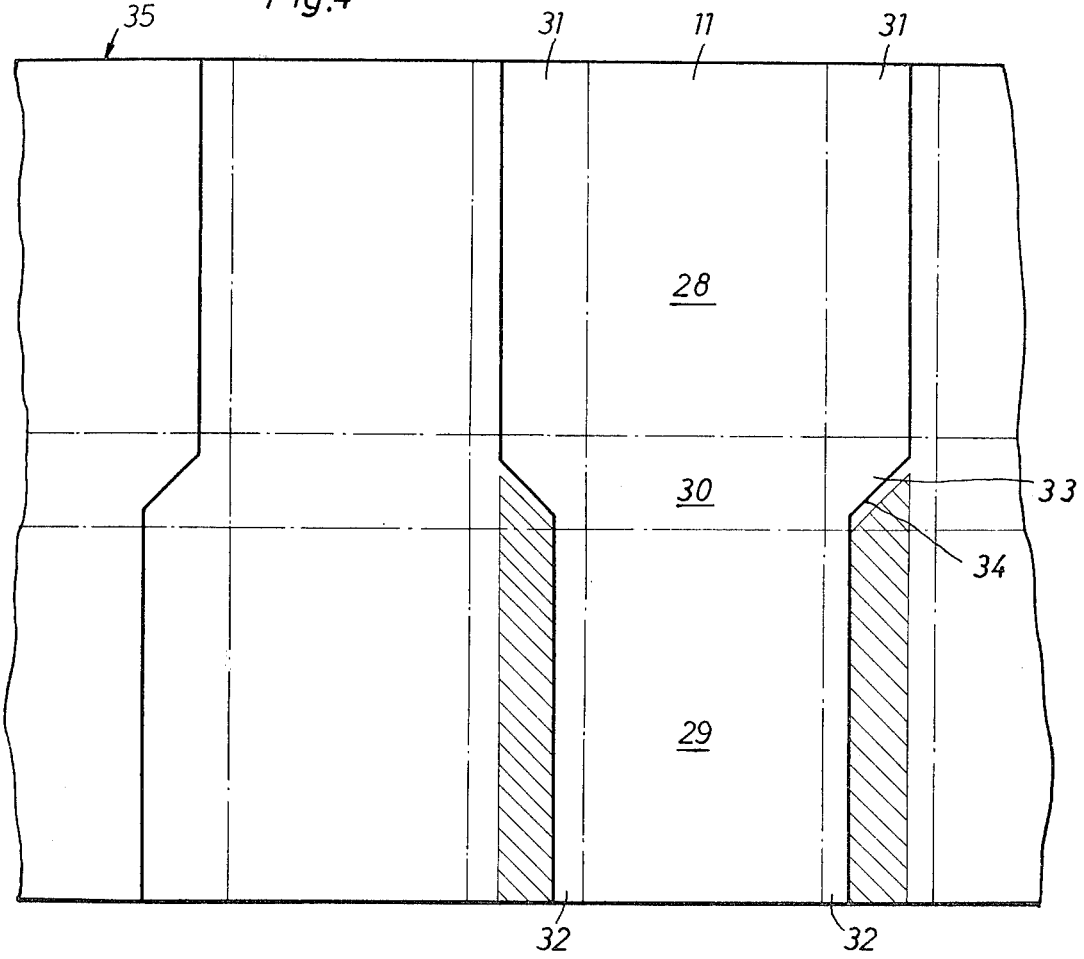
Figure 5:
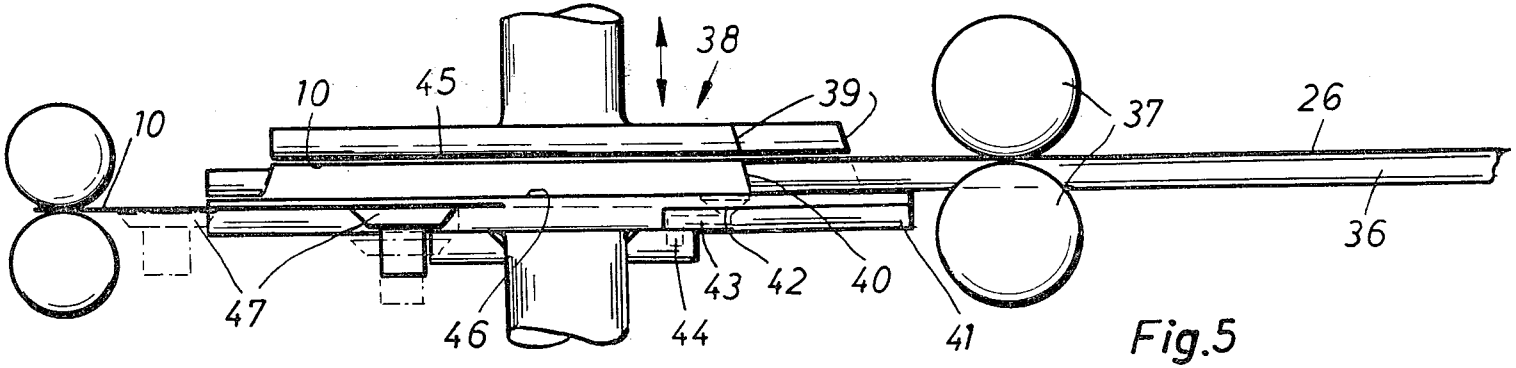
Figure 6:
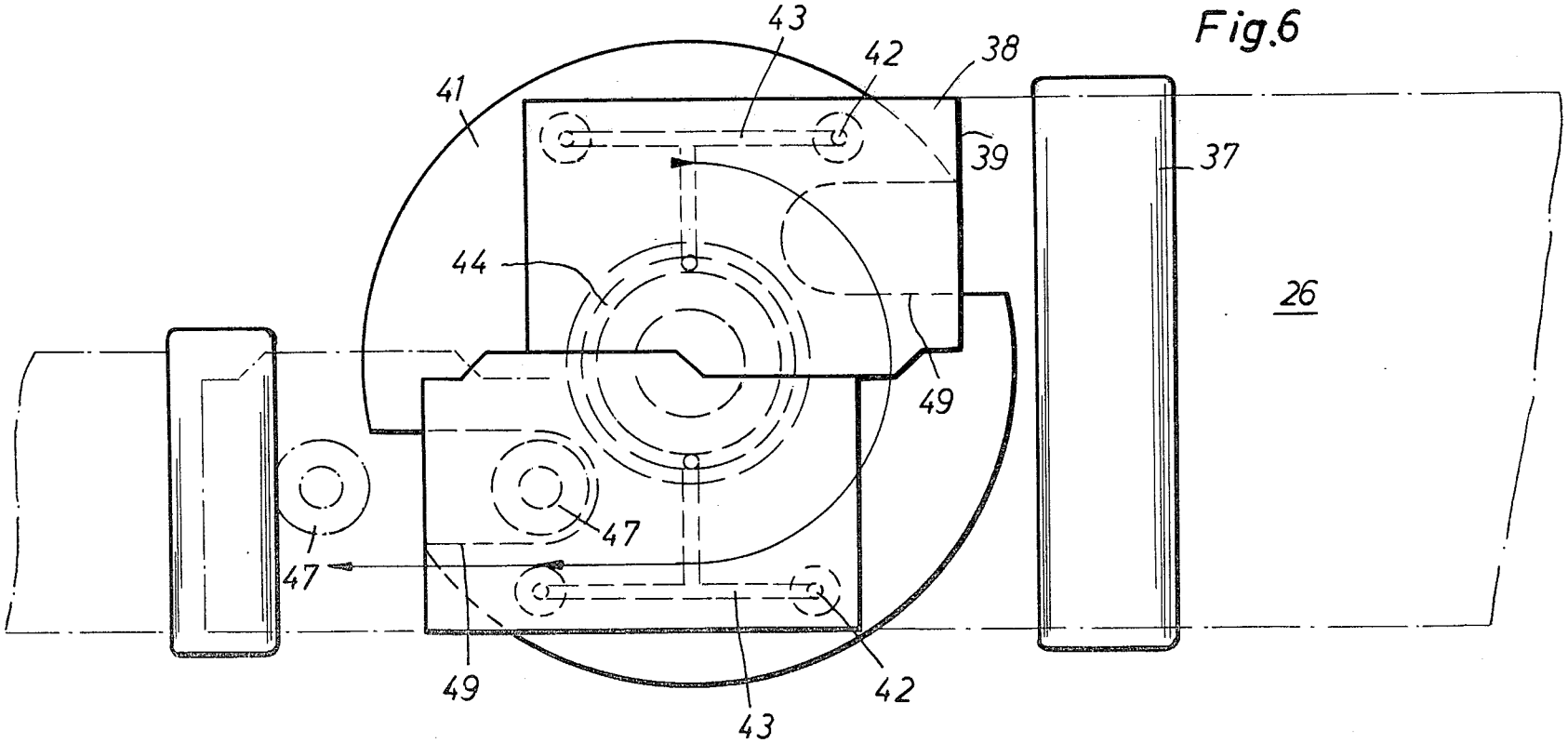
Figure 7:
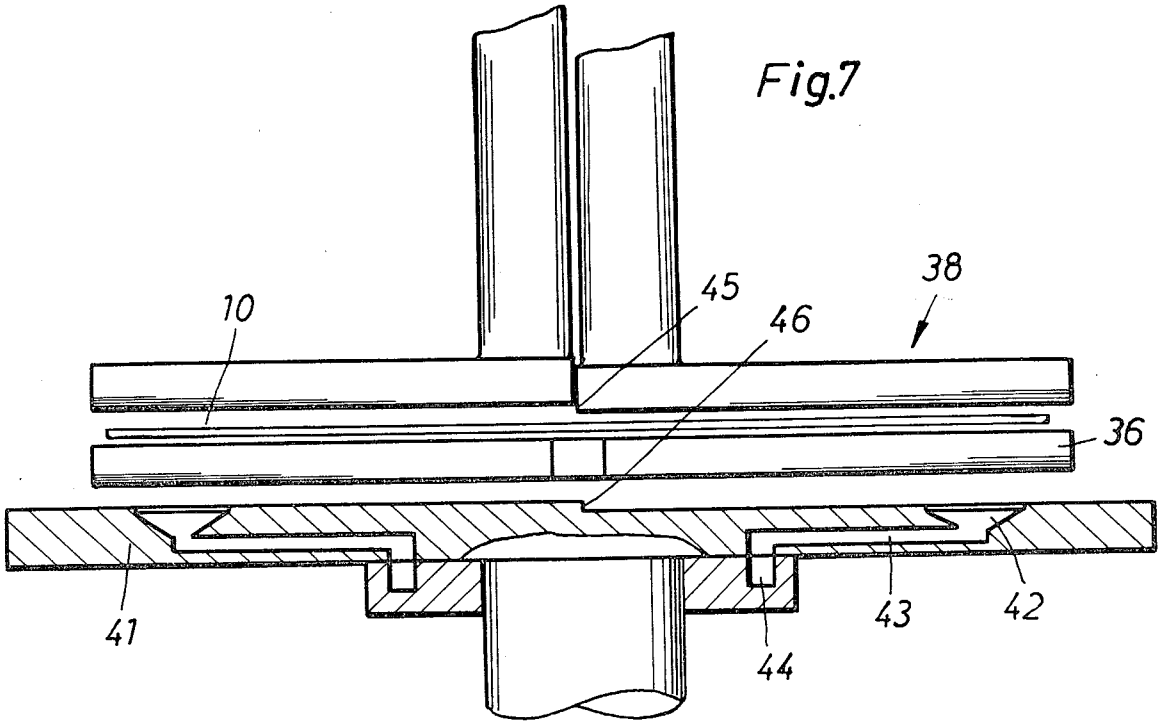

FIG. 1 shows the lower part of an embodiment of the wrapping of the invention in an intermediate folding position, in vertical cut, FIG. 2 shows a view of the bottom of the package as in FIG. 1 in a finished folded state, FIG. 3 is a section of a web of wrapping material with pre-marked blanks for packages as in FIGS. 1 and 2, FIG. 4 is a presentation according to FIG. 3 of a wrapping web with pre-marked blanks of an other embodiment, FIG. 5 is a side view of an apparatus for separating blanks from a web of wrapping and conveyance of it, partially cut, FIG. 6 is a top view presentation of FIG. 5, FIG. 7 is a presentation, shifted by 180°, of the apparatus as in FIGS. 5 and 6 in a side view as in FIG. 5.

The wrapping for cigarettes, discussed here in the first place, have been known as so-called soft wrappings. We are dealing with a blank 10 or 11, forming a part of this packing, made of paper etc., which envelops, as a "soft cup", the contents of the package, namely a block of cigarettes 12 with a tin foil. The wrapping formed by this blank 10 or 11 is predominantly developed such that the upper front surface of the package remains free. The wrapping extends thus merely in the area of a bottom 13, of mutually opposite, narrow side walls 14 and 15 as well as of likewise mutually opposite front 16 and rear walls 17. The blanks 10 or 11 for making up the wrapping may be made, according to the examples shown here, in two different types. In case of the construction of FIG'S. 1 to 3, first of all a hose with rectangular cross section is formed first from the blank 10, whereby a lateral flap 18, adjoining the lateral wall 15 formed as the intermediate structure, is connected with the inside of the adjoining edge of the rear wall 17. The hose, thus formed, projects in the area of bottom 13 to be formed, with bottom flaps beyond the contents of the package. In case of these bottom flaps we are dealing with a relatively wide bottom flap 19, almost corresponding to the width of the bottom 13, and with an opposite bottom flap 20, which is narrow as compared to the former. The previously mentioned bottom flaps 19 and 20 always adjoin a front wall 16 and a rear wall 17. Lateral terminal flaps 21 and 22 are formed between the previously mentioned bottom flaps 19 and 20 in extension of the lateral walls 14 and 15, which always form the transition between the wide bottom flaps 19 to the narrow bottom flap 20 with a level 23. The arrangement in case of the example shown is such that always an area of the lateral terminal flaps 21 and 22, facing the adjoining bottom flap 19 and 20, is developed in the width of the pertinent bottom flap and the bevelled edge 23 follows immediately.

The flaps, projecting in the area of the bottom 12 in the position as in FIG. 1, are folded in a certain way, namely such that the lateral terminal flaps 21 and 22 are folded back from the side toward the contents of the package. Then the narrow bottom flap 20 and finally the wide bottom flap 19 are folded back. As a result, the picture shown in FIG. 2, develops. At the same time the dimensions are such, that the free edge of narrow bottom flap 20 is completely covered up by the folded wide bottom flap 19. As a result, the outside impression of a slightly unsymetrical envelope fold develops. In order to make the afore-mentioned foldings more easy, folding lines 24 directed slantingly or at an angle to one another have been pre-impressed in the area of these projecting flaps 19 . . . 22. The walls 14 . . . 17 have also been delimited against each other by folding lines 25.

Of the blanks 10, developed in the preceding manner, always two are disposed side by side, transversely to the longitudinal direction of a web 26 of the wrapping material. The projections of the blanks 10, formed by the wide bottom flaps 19 and by the adjoining areas of the lateral terminal flaps 21 and 22, at the same time enter into depressions which are formed by the narrow bottom flaps 20 and adjoining areas of the lateral terminal flaps 21 and 22 of two successive blanks 10. In the area of the flaps 19 . . . 22, facing each other in the middle of the web, there develops as a result, an approximately meander-shaped continuous separating line 27 of two webs of labels guided side by side. These labels may be separated from the web 26 free of waste, by the exact positive engagement of the labels.

The same advantage will be achieved in case of a development of the blanks 11 in the sense of FIG. 4. In this case we are dealing with that type of this wrapping, where the front wall 28 and the rear wall 29 are interconnected via a bottom 30. Wide lateral flaps 31 adjoin in the area of the front wall 28 and narrow lateral flaps 32 in the area of the rear wall 29. The wide lateral flaps 31 at the same time have about transverse dimensions, which correspond approximately to the width of the lateral wall of the packing. Corner flaps 33 have been formed in the area of the bottom 30, which have a level 34 forming the transition between the lateral flaps 31 and 32 in the manner already explained in principle.

The wrapping from the previously mentioned blank 11 is formed such, that the blank is folded U-shape around the contents of the package while said bottom 30 fits against said contents. Then the lateral flaps 31 and 32 are folded back, and to be sure in such a way that the narrow lateral flap 32 rests on the inside and the wide lateral flap 31 on the outside.

These blanks 11 too, are separated free of waste from a web 35. The blanks 11 at the same time extend over the entire width of the web 35. The blanks 11 are always shifted by 180° in the longitudinal direction of said web, so that wide lateral flaps 31 and narrow lateral flaps 32 succeed each other.

In case of the embodiment of the blanks 10 as in FIG'S. 1 to 3, two blanks 10 lying side by side transversely to the web 26, are always separated simultaneously in one separating action. The blanks 10, which at first are connected along a separating line 27, are then separated from one another in the area of said separating line 27 and fed to a packaging station.

In case of the apparatus shown as an embodiment by way of example, the web 26 is fed-in on a locally fixed support 36, for example by way of feed rolls 37. The two blanks 10 here are separated by a punch 38 from the web 26. At the same time the web 26 is conveyed with the two blanks 10 underneath the plateshaped punch 38. The edge of the latter, facing the support 36 is developed as a cutting edge 39. The latter cooperates with a fixed counter edge 40, which is formed by the edge of the support 36. The cutting edge 39 and counter edge 40 follow the contour, produced by the shifted blanks 10 lying side by side (FIG. 6). As may further be recognized, the punch 38 has the cross sectional shape of the two blanks 10, which at first are still connected. The two blanks 10 are separated in the area of the counter edge 40 from the web 26, by a down movement of the punch 38.

By a further down-movement of the punch 38, said two blanks 10 are conveyed to a support, namely a turntable 41. The latter serves for the intermittent reception of the blanks 10. For mounting of the blanks 10, said turntable 41 has been provided with suction holes 42, which are connected in a basically known manner via suction channels 43 with a ring-shaped control channel 44. The latter is connected to a vacuum source.

The separation takes place in the area of the separating line 27 on the way to said turntable 41 or in case of placing the blanks 10 on said turntable. Here again the punch 38 acts as a movable cutting element with respect to a locally fixed counter edge 46. The cutting edge 45 of the punch 38 is formed by a correspondingly running section on the underside of the punch 38. The contour corresponds to that of the separating line 27. Quite correspondingly a counter edge 46 has been developed on the turntable 41. The previously mentioned edges are moved past each other, as a result of which a separating cut occurs.

The two blanks 10 are conveyed on by the turntable 41. At the same time the blanks 10 are moved away successively from the turntable 41. In case of the present embodiment a suction conveyor 47 has been provided for this purpose. The latter seizes every blank 10 by the underside and conveys it to a pair of feed rolls 48. The suction conveyor 47 enters into (engages with) a recess 49 of the turntable 41 in order to take over the blank 10. Two of these recesses 49 are always disposed in the area of a blank 10. The suction conveyor 47 is driven reciprocatingly or revolvingly, and to be sure in such a way that two conveying strokes of the suction conveyor 47 are performed after every separating stroke.

List of reference numbers:

| | | | |
|---|---|---|---|
| 10 | blank | 27 | separating line |
| 11 | blank | 28 | front wall |
| 12 | block of cigarettes | 29 | rear wall |
| 13 | bottom | 30 | bottom |
| 14 | lateral (side) wall | 31 | lateral flap |
| 15 | lateral (side) wall | 32 | lateral flap |
| 16 | front wall | 33 | corner flap |
| 17 | rear wall | 34 | bevel |
| 18 | lateral flap | 35 | web |
| 19 | bottom flap | 36 | support |
| 20 | bottom flap | 37 | feed rolls |
| 21 | lateral terminal flap | 38 | punch |

-continued

| List of reference numbers: | | | |
|---|---|---|---|
| 22 | lateral terminal flap | 39 | cutting edge |
| 23 | bevel | 40 | counter edge |
| 24 | folding line | 41 | turntable |
| 25 | folding line | 42 | suction holes (bars) |
| 26 | web | 43 | suction channel |
| 44 | control channel | 47 | suction conveyor |
| 45 | cutting edge | 48 | pair of feed rolls |
| 46 | counter edge | 49 | recess |

I claim:

1. A method for sequentially severing blanks for packaging, especially cigarette wrappings, from a continuously running web of packaging material in preparation for formation of packagings from the severed blanks, characterized in that:

(a) cutting of the blanks is performed with downward motion of a punch-type cutter with which adjacent blanks are cut with projections arranged 180° with respect to one another on the inside of the cut web, (b) after cutting of the blanks by the punch-type cutter, the cutter continues in a downward motion to separate the blanks and to lower the blanks from a feed plane to a delivery plane, (c) one of each two adjacent separated blanks is transported in the feed plane then the other of the two adjacent blanks is rotated through 180° by a turntable, and then the blanks are transported to a packaging station.

2. The method according to claim 1, wherein said blanks are separated from each other in such a manner that adjacent blanks are displaced relative to each other along the longitudinal direction of said web.

3. The method according to claim 2, wherein two blanks are separated from said web simultaneously along a separation line running lateral to said web, and that subsequently said two blanks are separated from each other by a second separating cut running in the longitudinal direction of said web.

4. The method of claim 1 wherein separation of said blanks by continued downward motion of said cutter is performed through cooperation of a cutting edge of said cutter cooperating with a counter edge of said turntable.

5. The method according to claim 1, wherein the lower sides of said blanks are acted upon for removal from said turntable.

* * * * *